US006312223B1

(12) United States Patent
Samuelsson

(10) Patent No.: US 6,312,223 B1
(45) Date of Patent: Nov. 6, 2001

(54) MARINE PROPELLER

(76) Inventor: Anders Samuelsson, Tullnäsvägen 90, S-945 91 Norrf järden (SE)

( * ) Notice: Subject to any disclaimer, the term of this patent is extended or adjusted under 35 U.S.C. 154(b) by 0 days.

(21) Appl. No.: 09/486,541

(22) PCT Filed: Sep. 24, 1998

(86) PCT No.: PCT/SE98/01719

§ 371 Date: Feb. 29, 2000

§ 102(e) Date: Feb. 29, 2000

(87) PCT Pub. No.: WO99/15399

PCT Pub. Date: Apr. 1, 1999

(30) Foreign Application Priority Data

Sep. 25, 1997 (SE) ..... 9703466

(51) Int. Cl.[7] ..... B63H 3/12; B63H 3/02

(52) U.S. Cl. ..... 416/2; 416/61; 416/93 A; 416/132 R; 416/153; 416/205; 416/208; 416/240; 416/207

(58) Field of Search ..... 416/2, 61, 153, 416/93 A, 205, 207, 208, 209, 214 R, 240, 132 R; 415/9; 440/50

(56) References Cited

U.S. PATENT DOCUMENTS

| | | | | |
|---|---|---|---|---|
| 813,074 | | 2/1906 | Barber . | |
| 1,963,531 | * | 6/1934 | Roberts | 415/240 |
| 2,574,951 | | 11/1951 | Benson . | |
| 2,953,208 | | 9/1960 | O'Connor . | |
| 3,033,293 | * | 5/1962 | Bihlmire | 416/240 |
| 3,050,282 | * | 8/1962 | Allen et al. | 416/2 |
| 3,130,677 | * | 4/1964 | Liebhart | 416/207 |
| 3,224,509 | * | 12/1965 | Thompson | 416/240 |
| 3,294,175 | * | 12/1966 | Bodner | 416/208 |
| 3,308,889 | | 3/1967 | Langhjelm et al. . | |
| 3,318,388 | * | 5/1967 | Bihlmire | 416/240 |
| 3,403,735 | | 10/1968 | Langhjelm et al. . | |
| 3,744,927 | * | 7/1973 | Bernaerts | 416/205 |
| 4,046,487 | * | 9/1977 | Lenz | 416/208 |
| 4,062,638 | * | 12/1977 | Hall, Jr. | 416/2 |
| 4,566,855 | * | 1/1986 | Costabile et al. | 416/93 A |
| 4,897,056 | | 1/1990 | Müller . | |
| 4,930,987 | * | 6/1990 | Stahl | 416/93 A |
| 5,232,345 | | 8/1993 | Rocco . | |
| 5,527,195 | * | 6/1996 | Neisen | 416/93 A |

FOREIGN PATENT DOCUMENTS

| | | | | |
|---|---|---|---|---|
| 742257-A | * | 7/1980 | (SU) | 416/208 |

* cited by examiner

*Primary Examiner*—Christopher Verdier
(74) *Attorney, Agent, or Firm*—Burns, Doane, Swecker & Mathis, L.L.P.

(57) ABSTRACT

A marine propeller includes a hub defining an axial direction of the propeller, a plurality of adjustable propeller blades disposed around the hub, and a blade setting adjusting arrangement. Each blade includes a blade-part and a root-part, the root-part being mounted in the hub and being turnable about an axis that defines an angle with the axial direction of the propeller.

10 Claims, 4 Drawing Sheets

MARINE PROPELLER

FIELD OF INVENTION

The present invention relates to a marine propeller. The adjustable blades of propellers according to the present invention enable the propeller to be adapted to different running conditions and different types of engines or motors. One advantage with such propellers is that they cover a wider area of use than fixed blade propellers. This enables propeller manufacturers and suppliers to satisfy the requirements of different users with a relatively limited number of types of propeller in the general assortment.

BACKGROUND OF THE INVENTION

Adjustable blade propellers have long been known. These propellers can be divided into two main types, one type with which each blade can be adjusted individually, and another type with which all blades are adjusted commonly in one single movement. One advantage with the latter type of propeller is that it eliminates the need to bring the individual setting of a blade into agreement with the settings of the remaining blades, which can be difficult to achieve and which may result in differences in blade settings.

The inventive propeller lies within this latter type of propeller, i.e. a propeller with which the propeller blades can be adjusted in unison.

Adjustable blade propellers of this kind are described and illustrated in U.S. Pat. Nos. 813,074, 2,574,951, 5,232,345, 2,953,208, 3,403,735, 3,308,889, for instance. A common feature of the propeller constructions described in these publications is that common or unison adjustment of the blades is made to a completely optional setting within the limits given, i.e. the blades can be adjusted to different settings smoothly and continuously. The blades are locked in their new settings, subsequent to this adjustment. This procedure has several drawbacks. Firstly, it is necessary to be able to read or determine the blade setting, so as to establish whether or not the blade has been adjusted to the angle intended. There is also the risk of deviation between the blade setting intended and the blade setting achieved. Furthermore, it is necessary to rely upon force-bound locking of the blades when practicing this continuous blade adjustment principle. This force-bound locking of the blades can result in a change in the blade setting, or may require the application of locking forces of such great magnitude as to cause dismantling and fitting operations in respect of the adjustment more difficult to achieve and induce higher tensions in the material. There is also the risk of a heavily tightened locking device becoming loose in the passage of time, due to vibration and other forces, so as to disturb the blade settings. As a result, a number of the earlier constructions have become highly complicated.

EP 0 300 252 teaches a blade adjuster with which the blades can be adjusted to distinct settings in unison. The arrangement is, however, relatively complicated and involves the conversion of a torsional adjustment movement to an axial adjustment movement of a rod that extends to each propeller blade, through the medium of nuts and spindles. The axial movement of the rod is then converted to rotational movement of respective blades through the medium of a pin carried by the rod and co-acting with a guide groove or channel in the blade root.

SUMMARY OF THE INVENTION

Against this background, it is an object of the invention to provide a propeller of the kind concerned with which the aforesaid problems associated with known techniques in this field have been avoided. More specifically, it is an object of the invention to provide a propeller of simple construction with which the blades can be adjusted to unequivocally defined and positively retained settings.

This object has been achieved in accordance with the invention.

Because the common adjustment movement is performed through the medium of relative movement between two elements, the adjuster ring and the hub, which can be shape-locked together in predetermined distinct positions, the blades can be adjusted to defined positions such as to eliminate the risk of accuracy deficiency and such as to obviate the need for measuring a precise position of adjustment or setting. All that is required to show to which of the predetermined positions the adjustment relates is a simple indication index. The shape-bound locking facility also ensures that the blade setting will not be disturbed and affected by vibrations and running disturbances. The inventive propeller is also of simple construction and therewith relatively inexpensive in manufacture.

According to one preferred embodiment of the invention, the means by which the adjustment adjuster ring and the hub are locked relative to one another in their circumferential direction are disposed on the mutually facing surfaces of said adjuster ring and said hub.

The locking elements suitably have the form of axially extending teeth with intermediate grooves or channels on each of the two surfaces.

The grooves and teeth have a complementary shape, so as to engage with one another in locking the adjuster ring and the hub together. One of said surfaces will include a plurality of teeth and the other at least one tooth, preferably several teeth. The teeth and the grooves ensure that the shape-bound locking effect is achieved and also define the blade settings.

According to another preferred embodiment, the movement transmission element that transmits rotation of the setting adjuster ring to the propeller blades is comprised of a plurality of arms, each of which is connected at one end to the root of a blade and the other end of which projects into a respective recess provided in the blade setting adjuster ring. This provides simple and reliable transmission of rotation of the adjuster ring to rotation of the propeller blades.

As a result of this simple construction of the blade adjusting mechanism, space can be provided for accommodating exhaust passages in the hub. A preferred embodiment of the invention thus includes such an arrangement of exhaust passages. This facility provided by said construction is particularly beneficial in view of the fact that the propeller is intended for use with several different types of drive motors.

According to one particularly beneficial embodiment of an inventive propeller, the blades are flexible so that their propelling behaviour will be influenced by operating or running conditions, which is of particular importance when the propeller blades can be adjusted in distinct steps. A preferred embodiment of the invention also relates to this facility.

According to another preferred embodiment, each blade has a weakened part that forms a fracture location. This prevents the hub from being damaged in the event of the propeller blades striking against a stone or some other object. This is of particular importance in respect of an inventive propeller, since a hub that is constructed for stepwise adjustment of the blade settings is more sensitive to external forces than a hub to which the blades are fixedly connected.

The features and advantages of the present invention are well understood by reading the following detailed description in conjunction with the drawings in which like numerals indicate similar elements and in which:

DETAILED DESCRIPTION OF A PREFERRED EMBODIMENT

Figure 1:
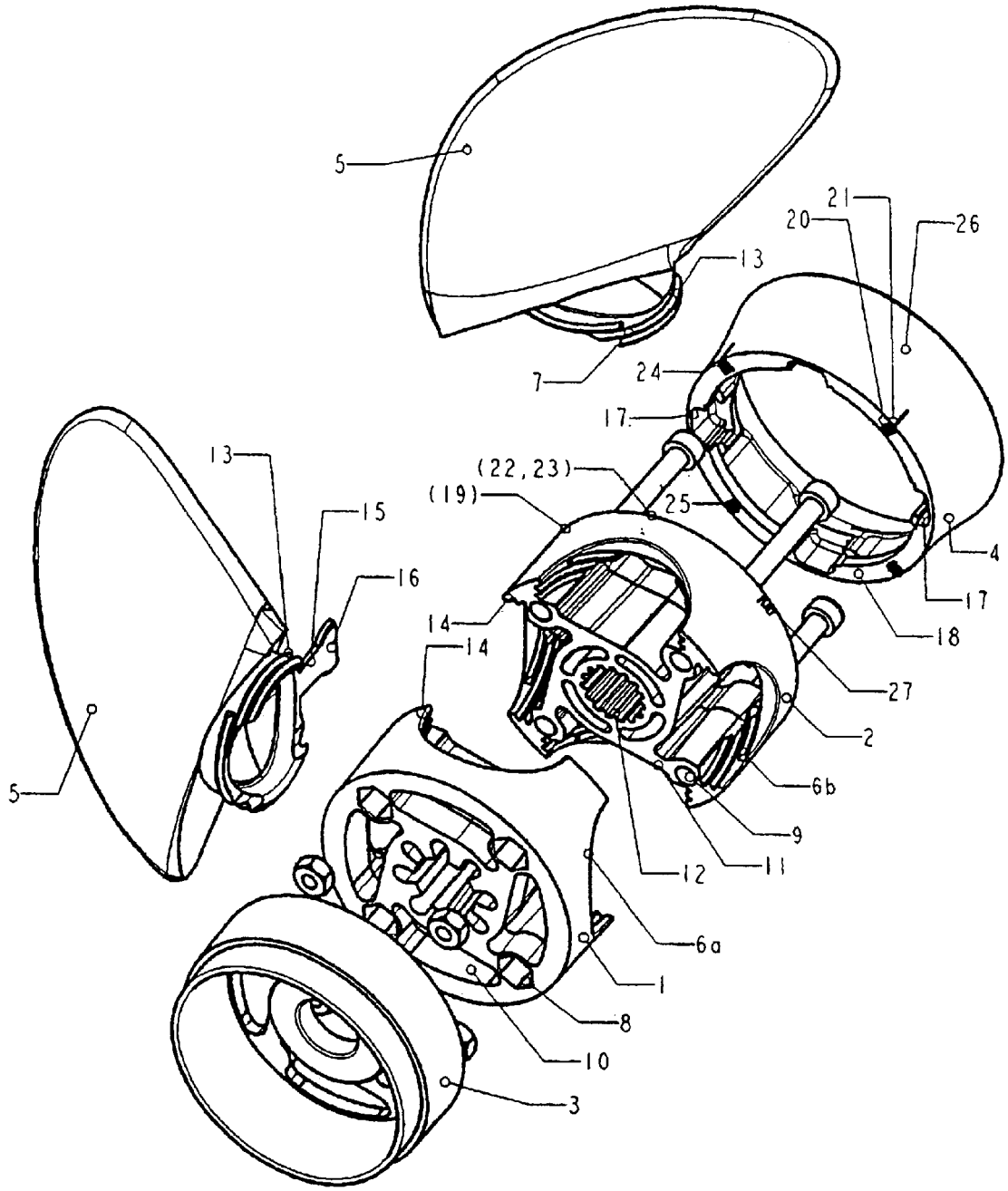
FIG. 1 is an exploded view of an inventive propeller.

FIG. 1 is an exploded view of an inventive propeller assembly which comprises a hub that includes a forward hub-half 1 and a rearward hub-half 2, a unit 3 for connection to the gear box of a drive motor, an adjustment adjuster ring 4, and four propeller blades 5, of which only two are shown in the Figure. Each of the two hub-halves 1, 2 is provided with four semi-circular recesses 6*a*, 6*b* which are located centrally of each other and which when assembled form circular bearings 6 for respective blades 5*y*. Each blade 5 has a circular base-part or root-part 7 by means of which it is rotatably mounted in one of the bearings 6. The two hub-halves 1, 2 are held together by four bolts (not shown) drawn through holes 8, 9 in the front and rear hub-halves respectively. The hub-parts include axially through-passing passages 10, 11 through which motor exhaust gases can pass. The propeller is driven by a shaft (not shown) extending from a motor, and the shaft is drivingly connected to the hub bore 12 in the rear hub-half 2, for instance by means of a spline coupling.

The root-part 7 of each blade includes a circumferentially extending projection 13 which projects out radially in relation to the rotational axis of the blade and which coacts with a corresponding groove or channel 14 in the hub-halves for mounting the blades to the hub and secures the blades in the radial direction of the propeller. A blade adjusting arm 15 is attached to the periphery of each root-part and extends generally radially relative to the rotational axis of the blade, i.e. extends generally in the direction of the propeller axis. The blade setting is adjusted by applying torque to the arm 15. When fitted, the arm 15 extends inwardly of the outer surface of the rear hub-half 2 and back towards the setting adjuster ring 4. Each arm 15 has a flared end-part 16 which, when the arm is fitted, is received in a recess 17 on the inner surface of the adjuster ring.

In operation, the adjuster ring 4 is fitted to the rear hub-half 2, wherewith a front annular end-surface 18 abuts a rear end-surface 19 (obscured in FIG. 1) of the rear hub-half 2. In this assembled states the adjuster ring 4 is fastened to the hub-half 2 by means of appropriate fasteners (not shown) and is secured against rotation by axially extending teeth 20 and intermediate grooves 21 on the end-surface 18 of the adjuster ring, said teeth and grooves co-acting with correspondingly shaped teeth and grooves 23 (obstructed in FIG. 1) on the end-surface 19 of the rear hub-part 2.

The adjuster ring 4 can be loosened from the rear hub-half 2 so as to be movable axially in relation thereto, and can be displaced slightly therefrom to a second position in which the teeth and grooves 20, 21, 22, 23 no longer co-act with one another. The adjuster ring 4 can be rotated relative to the rear hub-half 2 in this position. By rotating the adjuster ring 4 slightly and then re-fastening it to the rear hub-half 2, the teeth and the grooves 20, 21, 22, 23 will lock the adjuster ring in the new position. Rotation of the adjuster ring involves moving the adjuster ring axially through only a short distance such as to ensure that the teeth and the grooves are out of mutual engagement. However, the end-part 16 of respective blade setting adjusting arms 15 still protrude into the recesses 17 on the adjuster ring 4 in this position.

Thus, rotation of the adjuster ring 4 causes each arm 15 to rotate the root-part 7 of respective blades to a setting that depends on the angle through which the adjuster ring is rotated.

The positions to which the adjuster ring of the illustrated construction can be rotated are restricted to a number of distinct positions determined by the pitch of the teeth 20, 22. The blade settings can thus be adjusted incrementally and the number of setting positions is dependent on the number of teeth on the adjuster ring or on the rear hub-half. The adjuster ring 4 and the rear hub-half 2 need not have the same number of teeth. The number of rotational positions is determined by the unit that has the most teeth.

In principle, it is conceivably sufficient to provide the described locking device with teeth on only one peripheral part of the end-surface of the adjuster ring and the rear hub-half respectively. However, it may be convenient to provide corresponding pairs of engaging teeth at several places on these surfaces, as shown at 24 and 15 in the Figure. This arrangement provides a more positive locking effect.

In order to show visually the distinct rotational positions in which the rear hub-half 2 and the adjuster ring 4 are located, there is provided a scale 27 that includes a number of index marks on the outer surface of the rear hub-part 2, adjacent its end-surface 19. A setting marking 26 is provided at a corresponding position on the outer surface of the adjuster ring 4. The position of the setting marking 26 on the scale 27 therewith shows the rotational position of the blades.

Since all blades are provided with an adjusting arm 15 that co-acts with a respective recess 17 on the adjuster ring 4, the blades 5 will be rotated in unison as the adjuster ring 4 rotates.

Figure 2:
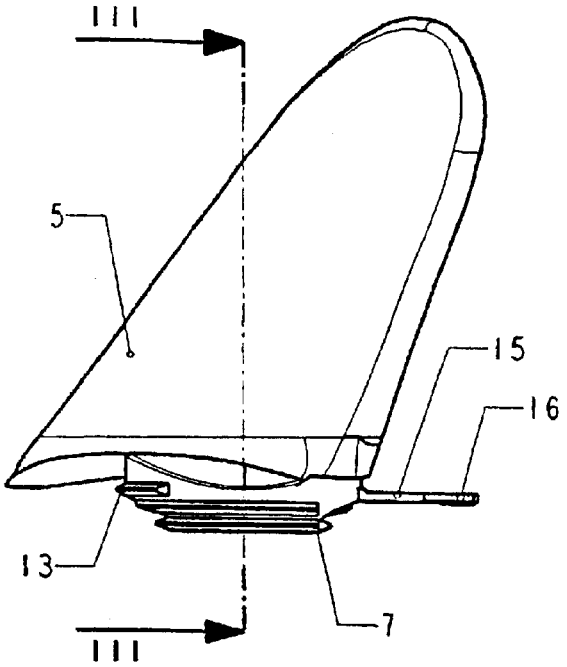
FIG. 2 is a side view of a propeller blade of an inventive propeller.

FIG. 2 illustrates in more detail the annular projections 13 and associated blade adjusting arms 15 adapted for mounting and radially securing the root-part 7 of each blade 5.

Figure 3:
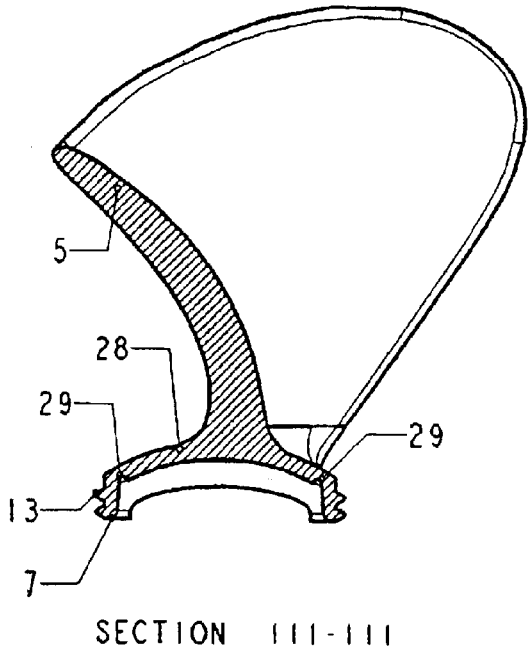
FIG. 3 is a sectional view taken on the line III—III in FIG. 2.

FIG. 3 is a sectional view taken on the line III—III in FIG. 2 and shows that the root-part 7 of the blade is hollow and includes an annular part on which the projections 13 are provided and a dome-shaped part 28 connected integrally with the actual blade 5. The inner surface of the dome-shaped part 28 has a circumferentially extending groove 29 which weakens the blade at its root and therewith functions as a fracture location. In the event of the blade 5 striking an obstacle, such as a stone, the blade will fracture at the groove 29 before the force reaches the hub and damages the same. This arrangement limits propeller damage to the blade whilst protecting the hub. It will be borne in mind that the hub of a propeller assembly that includes a blade setting adjusting arrangement of this kind is more expensive and less robust than the hub of a conventional propeller with fixed blades.

Figure 4:
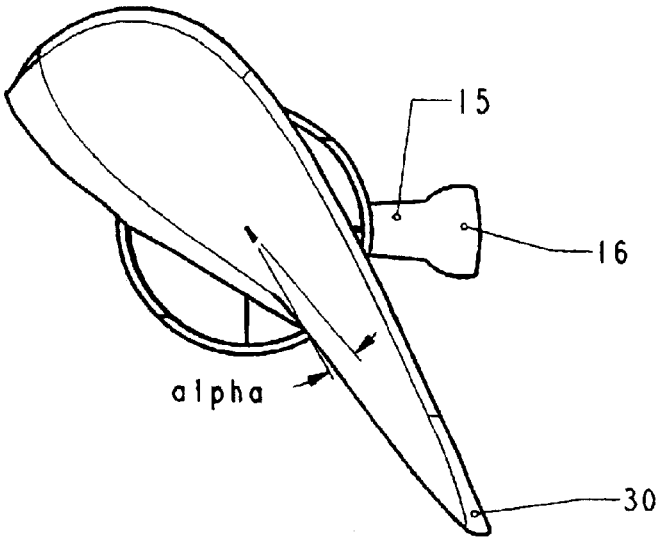
FIG. 4 is a view seen radially inwards of the blade in FIG. 2.

The propeller blades 5 are preferably made of a flexible material, for instance a plastic composite. When the blade 5 has a rearwardly swept profile, the outer part of the rear edge 30 of the blade will be urged forwards through an angle corresponding to the angle $\alpha$ and reach a forwardly displaced position indicated by the broken line in FIG. 4, therewith reducing the pitch. This takes place when the blade is subjected to a high load, for instance in response to acceleration. The greater the load, the greater the reduction in pitch, resulting in easier propulsion. There is thus obtained in this way some sort of "automatic gear function" which automatically reduces the pitch when the propeller is subjected to heavy loads, due to the flexibility of the material.

Figure 5:
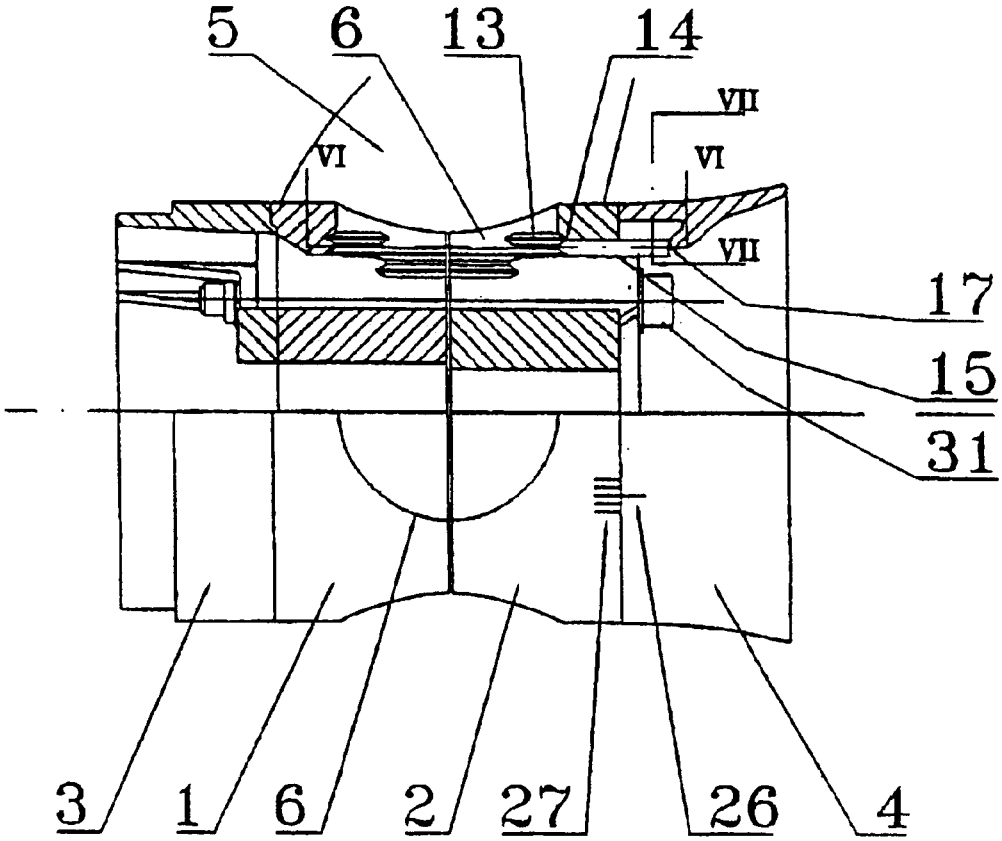
FIG. 5 illustrates the hub of an inventive propeller partly in side view and partly in axial section.

FIG. 5 is a cross-sectional view illustrating attachment of the blade 5 in the circular opening 6 formed between the two hub-parts 1, 2. The peripheral projections 13 on the blade root 7 co-act with grooves or channels 14 on the hub-halves, so as to secure and rotatably mount the blade in the hub. The end-part 16 of respective blade setting adjusting arms 15 extend into the recess 17 so as to be entrained by the adjuster ring 4 as it rotates and therewith rotate the blade 5. The adjuster ring 4 is shown in a locked position with its end-surface in abutment with the rear end-surface of the rear hub-half and with the mutually co-acting teeth and grooves (not visible in this Figure) on said surfaces in mutual locking engagement. Also shown in the Figure are four bolts 31 which hold the hub together. When adjusting the setting of the blades, the bolts 31 are first loosened sufficiently to enable the adjuster ring 4 to be moved axially through a distance required to move the teeth and the grooves out of engagement with one another and therewith enable the adjuster ring to be turned. Subsequent to turning the adjuster ring to a new position, the bolts are tightened in this position and the blade setting marking 26 is moved to another position opposite some other marking on the scale 27. The markings 26 and 27 may have the form of a painted line or a scored line.

Figure 6:
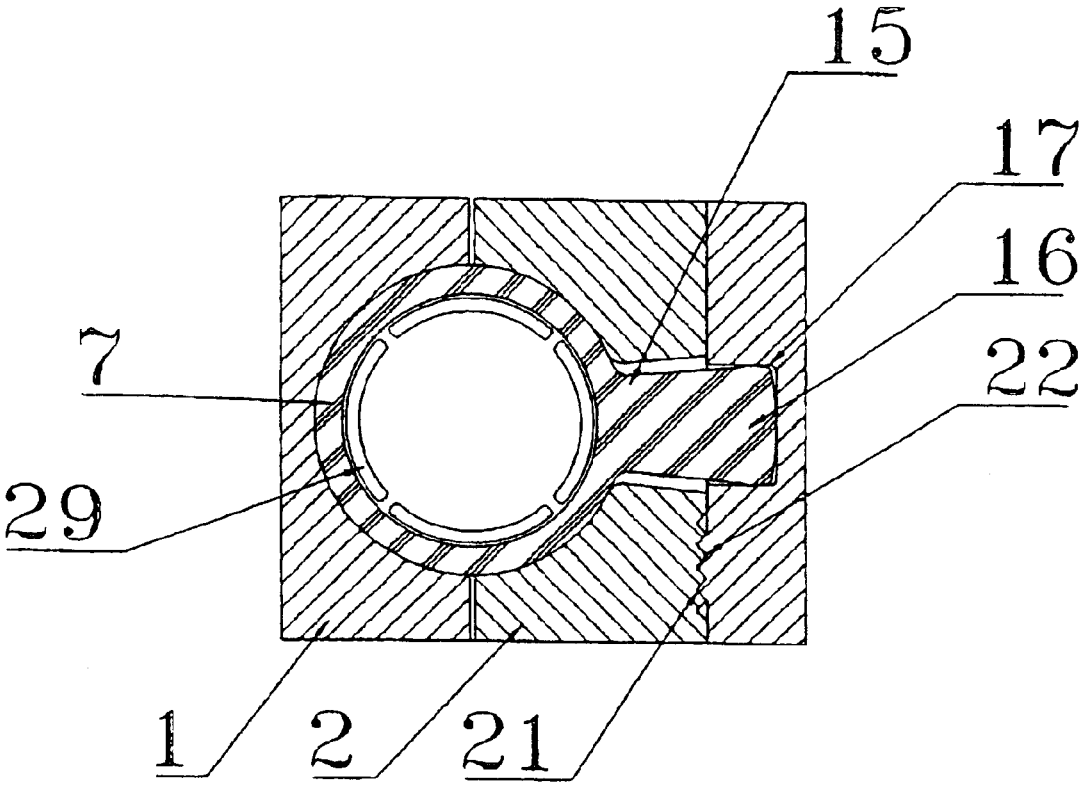
FIG. 6 is a sectional view taken on the line VI—VI in FIG. 5.
Figure 7:
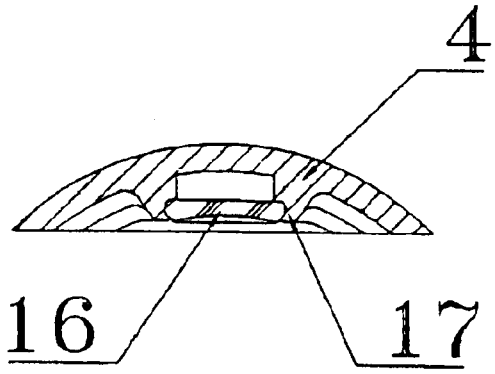
FIG. 7 is a sectional view taken on the line VII—VII in FIG. 5.

FIGS. 6 and 7 are sectional views taken respectively along the lines VI—VI and VII—VII in FIG. 5 and serve to further illustrate the mutual relationship of elements significant to blade setting adjustment. The above description made with reference to FIGS. 1 and 5 is believed to make FIGS. 6 and 7 self-explanatory.

What is claimed is:

1. A marine propeller comprising:

a hub defining an axial direction of the propeller;

a plurality of adjustable propeller blades disposed around the hub;

a blade setting adjusting arrangement;

each blade including a blade-part and a root-part, the root-part being mounted in the hub and being turnable about an axis that defines an angle with the axial direction of the propeller;

the blade setting adjusting arrangement being arranged to turn all blades in unison and including a blade setting adjusting ring including first locking means that coact with complementary second locking means provided on the hub, the adjuster ring being axially movable between a first axial position in which the first and the second locking means are in mutual locking engagement and a second axial position in which the first and the second locking means are out of engagement with one another and in which the adjuster ring is turnable relative to the hub, the first locking means and the second locking means permitting a plurality of distinct rotational positions of the adjuster ring relative to the hub, the blade setting adjuster ring being connected to each of the plurality of propeller blades by a movement transmission means for adjusting the rotational position of each propeller blade of the plurality of propeller blades incrementally in relation to a selected rotational position of the adjuster ring, the movement transmission means including a plurality of substantially axially extending adjusting arms, wherein one end of each arm of the plurality of arms is non-rotatably connected to a root-part of a propeller blade of the plurality of propeller blades and the other end of each arm of the plurality of arms is connected to the adjuster ring, and wherein the other end of each arm is adapted to accompany the adjuster ring as it is turned, wherein the adjuster ring has a first surface which faces towards the hub, and the hub has a second surface which faces towards the adjuster ring, and wherein the first locking means and the second locking means are arranged on the first and second surfaces, respectively, and wherein one of the first locking means and the second locking means includes a plurality of axially extending teeth which are disposed adjacent each other in the circumferential direction and mutually separated by intermediate grooves or channels, and wherein the other of the first and said second locking means includes at least one axially extending tooth that has a shape complementary to the grooves or channels.

2. A propeller according to claim 1, wherein the rotational axis of each root-part extends substantially perpendicular to the axial direction of the propeller, and wherein all of the rotational axes of all of the roots of all of the plurality of propeller blades are located in a common radial plane.

3. A propeller according to claim 2, wherein the adjuster ring includes a number of arm-receiving recesses, and wherein, for each arm of the plurality of arms, the other end extends into one of the recesses.

4. A propeller according to claim 2, wherein the hub and the adjuster ring include indicating means which function to indicate to which of the distinct positions the adjuster ring and the hub are turned in relation to one another.

5. A propeller according to claim 1, wherein the adjuster ring includes a number of arm-receiving recesses, and wherein, for each arm of the plurality of arms, the other end extends into one of the recesses.

6. A propeller according to claim 5, wherein the hub and the adjuster ring include indicating means which function to indicate to which of the distinct positions the adjuster ring and the hub are turned in relation to one another.

7. A propeller according to claim 1, wherein the hub includes axially extending passages through which exhaust gases generated by a motor driving the propeller can pass.

8. A propeller according to claim 1, wherein each blade is made of a flexible material of sufficient flexibility to enable the shape of the blade to be changed by forces applied on the blade during operation in water.

9. A propeller according to claim 1, wherein each blade includes a weakened part that forms a fracture location.

10. A propeller according to claim 1, wherein the hub and the adjuster ring include indicating means which function to indicate to which of the distinct positions the adjuster ring and the hub are turned in relation to one another.

* * * * *